US007547109B2

(12) United States Patent
Schmidt et al.

(10) Patent No.: US 7,547,109 B2
(45) Date of Patent: Jun. 16, 2009

(54) PHOTO-CHROMIC MATERIAL APPLICATION APPARATUS

(75) Inventors: Christopher B. Schmidt, Oakland, CA (US); William J. Hudson, Pleasanton, CA (US); Sunil W. Moothedah, Pleasanton, CA (US); David B. Small, San Jose, CA (US); Paul S. Rago, Danville, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 336 days.

(21) Appl. No.: 11/469,410

(22) Filed: Aug. 31, 2006

(65) Prior Publication Data

US 2007/0109770 A1 May 17, 2007

Related U.S. Application Data

(60) Provisional application No. 60/713,449, filed on Sep. 1, 2005.

(51) Int. Cl.
*B43K 29/10* (2006.01)

(52) U.S. Cl. ..... 362/118; 446/219

(58) Field of Classification Search ..... 362/118, 362/84; 446/219
See application file for complete search history.

(56) References Cited

U.S. PATENT DOCUMENTS

| | | | | |
|---|---|---|---|---|
| 1,807,415 | A | 5/1931 | La France | |
| 2,297,033 | A | 9/1942 | Stahr | |
| 2,730,993 | A | 1/1956 | Boyle | |
| 2,882,246 | A | 4/1959 | Leatherman et al. | |
| 2,921,407 | A | 1/1960 | Wagner et al. | |
| 3,074,975 | A | 1/1963 | McCormick et al. | |
| 3,134,674 | A | 5/1964 | Brown, Jr. | |
| 3,166,050 | A | 1/1965 | Fehling et al. | |
| 3,443,332 | A | 5/1969 | Christy | |
| 3,652,285 | A | 3/1972 | Delzenne et al. | |
| 3,696,098 | A | 10/1972 | Hoefnagels et al. | |
| 3,813,554 | A * | 5/1974 | Chang et al. | 250/461.1 |
| 3,933,708 | A | 1/1976 | Brinkman | |

(Continued)

FOREIGN PATENT DOCUMENTS

| | | |
|---|---|---|
| JP | 07-314984 | 12/1995 |

(Continued)

OTHER PUBLICATIONS

"International Search Report and Written Opinion of the International Searching Authority Dated Aug. 7, 2008", *International Application No. PCT/US06/33644.*

(Continued)

*Primary Examiner*—Ali Alavi
(74) *Attorney, Agent, or Firm*—Blakely Sokoloff Taylor & Zafman LLP

(57) ABSTRACT

In one embodiment of the invention, photo-chromic applicators are disclosed. The photo-chromic applicator may include a liquid photo-chromic material such as a photo-chromic ink or paint. The photo-chromic material is applied to a surface of a toy, a page, or other object by a child user. The photo-chromic material may be activated in various ways with various light activating devices that can generate the activating light with appropriate wavelengths.

18 Claims, 8 Drawing Sheets

U.S. PATENT DOCUMENTS

| | | | | |
|---|---|---|---|---|
| 3,980,300 | A | 9/1976 | Hornsby, Jr. | |
| 4,026,869 | A | 5/1977 | Evens et al. | |
| 4,036,805 | A | 7/1977 | Tsujimoto et al. | |
| 4,134,853 | A | 1/1979 | Ehrlich et al. | |
| 4,212,786 | A | 7/1980 | Murakami | |
| 4,257,188 | A | 3/1981 | Barker | |
| 4,427,387 | A | 1/1984 | Tomita | |
| 4,525,214 | A | 6/1985 | Panken | |
| 4,590,381 | A | 5/1986 | Mendelson | |
| 4,599,614 | A | 7/1986 | DeBerry et al. | |
| 4,779,166 | A | 10/1988 | Tanaka et al. | |
| 4,826,550 | A | 5/1989 | Shimizu et al. | |
| 4,844,990 | A | 7/1989 | White | |
| 4,917,643 | A | 4/1990 | Hippely et al. | |
| 5,001,243 | A | 3/1991 | Fischer et al. | |
| 5,091,006 | A | 2/1992 | Sarada et al. | |
| 5,177,227 | A | 1/1993 | Fischer et al. | |
| 5,190,298 | A | 3/1993 | Lee et al. | |
| 5,203,702 | A * | 4/1993 | Wilson | 434/85 |
| 5,208,132 | A | 5/1993 | Kamada et al. | |
| 5,208,354 | A | 5/1993 | Fischer et al. | |
| 5,294,522 | A | 3/1994 | Uchida et al. | |
| 5,407,885 | A | 4/1995 | Fischer et al. | |
| 5,441,418 | A | 8/1995 | Brown et al. | |
| 5,474,603 | A | 12/1995 | Miyashita et al. | |
| 5,480,338 | A | 1/1996 | Barthold | |
| 5,498,280 | A | 3/1996 | Fistner et al. | |
| 5,503,583 | A | 4/1996 | Hippely et al. | |
| 5,914,197 | A | 6/1999 | Goudjil | |
| 5,936,878 | A | 8/1999 | Arsenov et al. | |
| 5,945,252 | A | 8/1999 | Sokoluk et al. | |
| 6,036,334 | A | 3/2000 | Nakano | |
| 6,074,465 | A | 6/2000 | Fukuo et al. | |
| 6,099,629 | A | 8/2000 | Morita et al. | |
| 6,145,512 | A | 11/2000 | Daley | |
| 6,322,416 | B1 | 11/2001 | Burke | |
| 6,585,555 | B2 | 7/2003 | Wong et al. | |
| 6,860,616 | B2 * | 3/2005 | Yu et al. | 362/118 |
| 6,902,334 | B1 | 6/2005 | Kung | |
| 6,916,537 | B2 | 7/2005 | Welch et al. | |
| 2003/0127797 | A1 | 7/2003 | Katz et al. | |
| 2003/0137258 | A1 | 7/2003 | Piepgras et al. | |
| 2004/0076460 | A1 | 4/2004 | Yu et al. | |
| 2004/0135097 | A1 * | 7/2004 | Shibahashi et al. | 250/474.1 |
| 2004/0266554 | A1 | 12/2004 | Park et al. | |

FOREIGN PATENT DOCUMENTS

| | | |
|---|---|---|
| JP | 07314984 | * 12/1995 |

OTHER PUBLICATIONS

Sanghavi, Jayesh Manilal, trade lead for Photo Chromic Text Screen Ink, Jun. 19, 2004, 1 page, www.tradeindia.com.

Chromatic Technologies, Incorporated, DynaColor Data Sheet for Photochormic Water-Based Flexographic Ink, Revised Sep. 2004, 3 pages, http://www.ctiinks.com.

Chromatic Technologies, Incorporated, DynaColor Data Sheet for Photochromic UV Offset Ink, Revised Sep. 2004, 2 pages, http://www.ctiinks.com.

Chromatic Technologies, Incorporated, DynaColor Data Sheet for Photochormic UV Flexographic Ink, Revised Sep. 2004, 2 pages, http://www.ctiinks.com.

Chromatic Technologies, Incorporated, DynaColor Data Sheet for Photochormic Flexographic Ink, Revised Sep. 2004, 1 page, http://www.ctiinks.com.

Chromatic Technologies, Incorporated, DynaColor Data Sheet for Photochormic Textile Screen Ink, Revised Sep. 2004, 1 page, http://www.ctiinks.com.

Chromatic Technologies, Incorporated, DynaColor Data Sheet for Glow-in-the-Dark UV Offset Ink, Revised Sep. 2004, 2 pages, http://www.ctiinks.com.

Chromatic Technologies, Incorporated Corporate Website Page, 1 page. 2005.

* cited by examiner

FIG. 1A
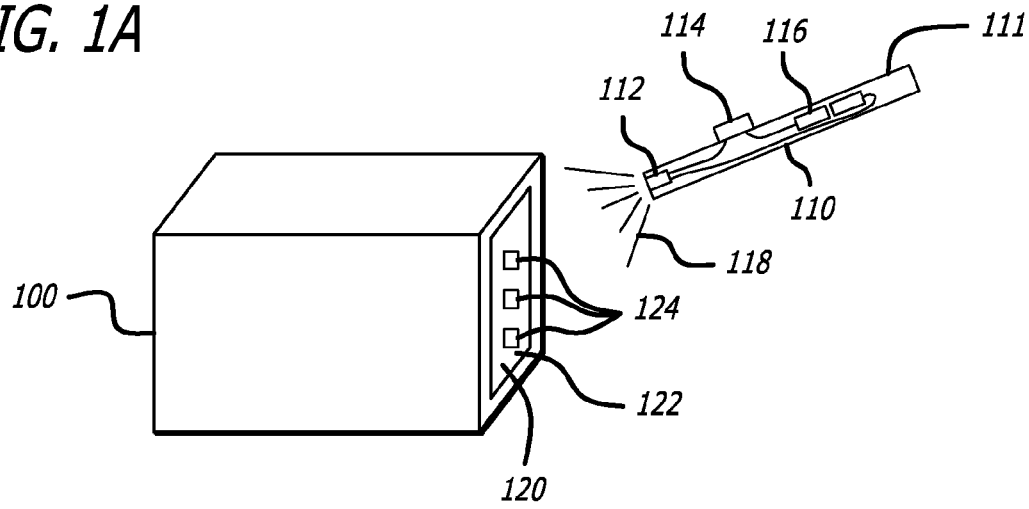
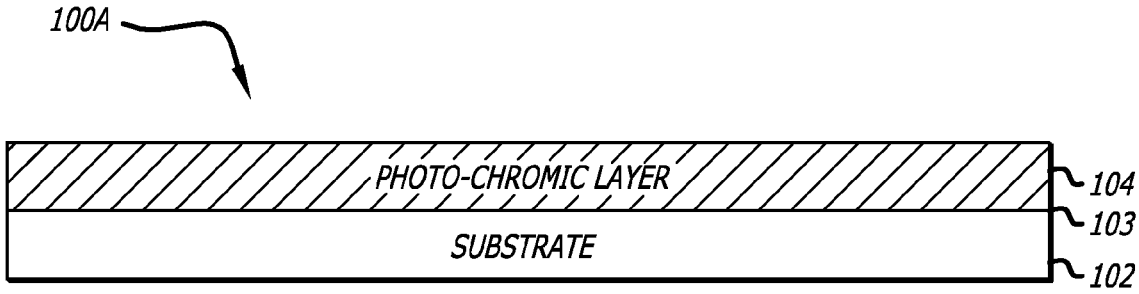
FIG. 1B
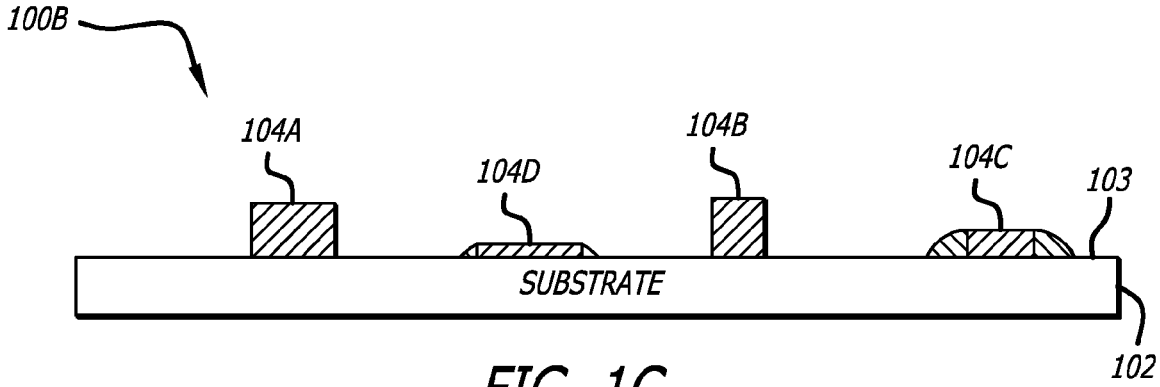
FIG. 1C

PHOTO-CHROMIC MATERIAL APPLICATION APPARATUS

CROSS-REFERENCE TO RELATED APPLICATIONS

This non-provisional United States (U.S.) patent application claims the benefit of U.S. Provisional Patent Application No. 60/713,449 filed on Sep. 1, 2005 by inventors Chris Schmidt, et al., entitled Photo-Chromic Writing, Drawing and Printing Apparatus.

FIELD

The embodiments of the invention relate generally to writing, drawing, and printing instruments. More particularly, the embodiments of the invention relate to apparatus to write, draw, and print using photo-chromic materials.

BACKGROUND

A photo-chromic material is a material that is initially transparent or translucent. The photo-chromic material can be temporarily transformed into being a reflective color by the application of an appropriate spectrum of electromagnetic radiation or light. That is, upon transformation, photo-chromic materials reflect background light and are not transparent or translucent for a period of time.

In contrast, phosphorescent materials, sometimes referred to as glow-in-the-dark materials, absorb electromagnetic radiation to become charged or activated. Upon removal of the electromagnetic radiation source, phosphorescent materials do not reflect but emit a light of limited intensity light that decays rather quickly. The light emitted by phosphorescent materials is typically visible in complete darkness or low background light conditions for a very limited period of time.

The chemical makeup of photo-chromic materials is well known. For example, photo-chromic materials and compounds may be formed out of naphtacenequinones and derivatives thereof. It is known that various colors may be achieved by using derivatives of naphtacenequinones as is described in U.S. Pat. No. 4,036,805 by Tsujimoto et al. which is incorporated herein by reference.

While the chemical makeup of photo-chromic materials and compounds are well known, the application of them to useful products has been rather limited.

One industrial use of photo-chromic materials is to store data in three dimensions in a solid state optical memory or an optical disk of a disk drive to try and increase data density within a given volume of space.

While industrial applications of photo-chromic materials are important, it is also desirable to use photo-chromic materials in other ways.

BRIEF SUMMARY

The embodiments of the invention are summarized by the claims that follow below.

BRIEF DESCRIPTIONS OF THE DRAWINGS

FIG. 1A is a block diagram of a photo-chromic toy.

FIG. 1B is a cross-section of a portion of a photo-chromic toy.

FIG. 1C is a cross-section of differing portion of a photo-chromic toy.

DETAILED DESCRIPTION

Figure 2:
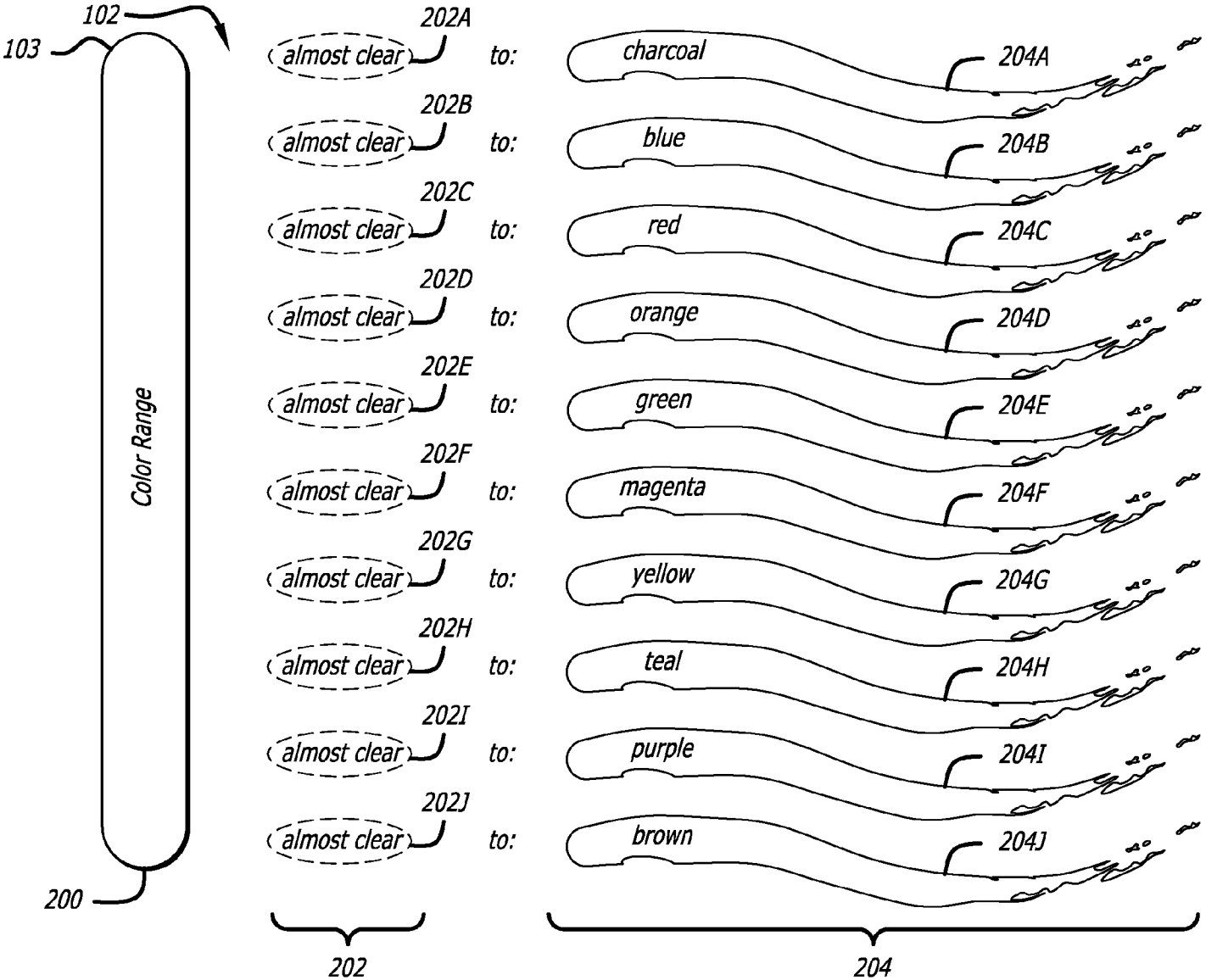
FIG. 2 is a diagram of swatches of photo-chromic ink illustrating their various color when activated and how it may be applied.

In the following detailed description of the embodiments of the invention, numerous specific details are set forth in order to provide a thorough understanding of the present invention. However, it will be obvious to one skilled in the art that the embodiments of the invention may be practiced without these specific details. In other instances well known methods, procedures, components, circuits, systems, and subsystems have not been described in detail so as not to unnecessarily obscure aspects of the embodiments of the invention.

The embodiments of the invention include methods, apparatus, kits, and play-sets for children and hobbyists to apply photo-chromic inks, dyes, and paints to objects.

Photo-chromic Toys

Referring now to FIG. 1A, a block diagram of a photo-chromic toy 100 is illustrated. The photo-chromic toy 100 includes a photo-chromic material such as a photo-chromic ink or paint, plastic, or dye. The photo-chromic material may be supplied in a material of the toy or applied to a surface of the toy at the factory or it may be applied by a user to the toy or the surface. The photo-chromic material may be activated in various ways with various devices.

A photo-chromic ink or paint has a finely divided photo-chromic solid suspended in an ink-like or paint-like carrier. The photo-chromic ink or paint is functionally more flexible in that it may be applied by a manufacturer at the factory or by a user outside the factory. In at least one embodiment of the invention, the photo-chromic ink or paint is in liquid or colloidal form so that it can be applied to a toy or a writing or drawing surface. In other embodiments of the invention, the photo-chromic ink or paint is dried into a solid on a surface of the toy. In other embodiments of the invention, photo-chromic solids are mixed in with a plastic and molded into the toy at the factory. In other embodiments of the invention, a surface of the toy is dyed at the factory with a photo-chromic dye.

The photo-chromic toy 100 may further include a three dimensional structure that is solid or hollow. The structure or portion thereof of the toy may provide a substrate with a surface to which the photo-chromic material may be applied.

The photo-chromic ink or paint is generally activated by light or electromagnetic radiation substantially in or near the purple, violet, or ultraviolet (UV) spectrum. Sunlight can readily activate the photo-chromic ink or paint. Typical white indoor lighting from incandescent or fluorescent lights doesn't have sufficient intensity in the wavelength range of light or electromagnetic radiation to activate photo-chromic ink or paint. Thus when indoors or shaded from the sun, a source of purple, violet, or ultraviolet light may be used to activate the photo-chromic ink or paint. A light with a wavelength within the spectrum of purple, violet, and ultraviolet light that activates photo-chromic material may be collectively referred to herein as an activating light. For example, a black light that provides some UV radiation may be used indoors to activate the photo-chromic ink or paint.

In other embodiments, a light pen, a light sprayer, a light wand, or a light marker may be used to activate a smaller area of photo-chromic ink or paint. FIG. 1A illustrates a light pen, a light sprayer, a light wand, or a light marker 110 that may be used to provide an activating light to a smaller area of photo-chromic ink or paint on the photo-chromic toy. For convenience, the light pen, light sprayer, light wand, and light marker may be collectively referred to as light pen 110.

The light pen 110 includes a housing 111 to collectively hold together a light transducer 112, a switch 114, and one or more batteries 116 as a portable unit. The switch 114 switches the power supplied by the batteries 116 to the light transducer 112 ON and OFF to periodically generate the electromagnetic radiation or light (also referred to as an "activating light") 118. When ON, the light transducer 112 converts electrical current into the activating light in the range of wavelengths to activate photo-chromic material. The light transducer 112 may be a light bulb, a flash bulb, or a light emitting diode (LED) that can generate the activating light. The structure of the housing 111 may take on different ornamental shapes depending upon the context of the photo-chromic toy 100. Collectively, the light pen 110 and photo-chromic toy 100 may form a playset.

In FIG. 1A, a stencil 120 may further be used to mask out portions of the activating light to form an activated pattern in the photo-chromic material. The stencil 120 includes opaque areas 122 to block the activating light and transparent areas 124 to allow the activating light through to the photo-chromic material. The transparent areas 124 may simply be openings in the stencil to allow the activating light through. Collectively, the light pen 110, photo-chromic toy 100 and stencil 120 may form another playset.

Referring now to FIG. 1B, a cross-section of a portion of a photo-chromic toy 100A is illustrated. The photo-chromic toy 100A includes a substrate 102 with a photo-chromic ink or paint layer 104 applied across a whole portion of a surface 103 of the substrate 102. Typically, the surface 103 is the outer surface of the substrate 102 and toy 100A so that the photo-chromic ink or paint is visible to the eye. The substrate 102 is a solid and may be formed out of plastics, vinyl, fabric, papers, woods, metals, combinations thereof, or other known solids.

Referring now to FIG. 1C, a cross-section of another portion of a photo-chromic toy 100B is illustrated. The photo-chromic toy 100B includes the substrate 102 with a photo-chromic ink or paint 104A-104D applied at portions of the surface 103 of the substrate 102 in contrast to be applied over the whole portion as in FIG. 1B. The photo-chromic ink or paint 104A-104D may be applied to selected portions of the surface 103 of the substrate 102 through the use of masking techniques such as with a mask, for example.

Generally, the photo-chromic ink or paint may be applied to surfaces of substrates similar to how inks and paints are applied to surfaces. The shape, width, and thickness of the photo-chromic ink or paint may vary depending upon how it is applied to the surface 103 of the substrate 102. The photo-chromic ink or paint 104A is thicker than the photo-chromic ink or paint 104D. The photo-chromic ink or paint 104A is wider than the photo-chromic ink or paint 104B. The photo-chromic ink or paint 104A-104B are more sharply defined at the edges than the photo-chromic ink or paint 104C-104D which are more rounded at the edges.

Referring now to FIG. 2, exemplary methods as to how the photo-chromic ink or paint may be applied to surfaces of a substrate and the various colors to which photo-chromic ink or paint may change are illustrated. The photo-chromic ink or paint may be applied to a substrate by silk screening as illustrated by the oval 200. Alternatively, the photo-chromic ink or paint may be applied to a substrate by offset printing as illustrated by the ovals 202. Alternatively, the photo-chromic ink or paint may be applied to a substrate by being sprayed on as illustrated by the brush-strokes or swatches 204.

As discussed previously, the photo-chromic ink or paint is generally activated by light or electromagnetic radiation substantially in or near the purple, violet, or ultraviolet (UV) spectrum. After being activated, the photo-chromic ink or paint appears to change from being substantially transparent or clear to a color. Alternatively, the color of the photo-chromic ink or paint may appear to change in intensity due to increased reflectivity. Alternatively, the photo-chromic ink or paint may appear to change colors, such as from a substantially white color to a different color other than white. After activation, the change to color, intensity, or different color may persist for approximately thirty seconds, more or less. The persistence of change in the photo-chromic ink or paint may last shorter or longer depending how its activated and for what length of time. Without further activation, the change in the photo-chromic ink or paint may gradually decay back to an inactivated state.

When not activated, in one embodiment of the invention the photo-chromic ink or paint may be substantially transparent so that it is clear and shows the color of the surface 103 of the substrate 102, as is illustrated by the oval 200. For example, the white color of the surface of the paper substrate shows through the oval 200 of the photo-chromic ink or paint. The surface of the substrate may include indicia or other printing underneath the photo-chromic ink or paint that is revealed when not activated but colored when activated.

When not activated, in another embodiment of the invention the photo-chromic ink or paint may almost be clear or transparent, somewhat translucent, having a hint of color to distort the color of the surface 103 of the substrate 102, as is illustrated by the ovals 202A-202J. Oval 202A has a hint of charcoal grey color. Oval 202B has a hint of blue color. Oval 202C has a hint of red color. Oval 202D has a hint of orange color. Oval 202E has a hint of green color. Oval 202F has a hint of magenta color. Oval 202G has a hint of yellow color. Oval 202H has a hint of teal color. Oval 202I has a hint of purple color. Oval 202J has a hint of brown color.

When activated, the intensity of the color of the ovals 202A-202J may increase as illustrated by the activated photochromic ink or paint of the brush-strokes or swatches 204A-204J, respectively. Brush-stroke 204A is a charcoal grey color. Brush-stroke 204B is a blue color. Brush-stroke 204C is a red color. Brush-stroke 204D is a orange color. Brush-stroke 204E is a green color. Brush-stroke 204F is a magenta color. Brush-stroke 204G is a yellow color. Brush-stroke 204H is a teal color. Brush-stroke 204I is a purple color. Brush-stroke 204J is a brown color.

Additionally, the colors of the photo-chromic ink or paint may be layered on top of one another. A plurality of lines of different colors of the photo-chromic ink or paint may be placed side by side so that a rainbow of colors may be observed by a user when activated.

The photo-chromic ink or paint may be applied to various types of children's toys and playthings. The photo-chromic ink or paint may also be activated in different ways by differing light devices. Templates or masks may be used that have opaque portions to shade areas of the photo-chromic ink or paint from light and activation and open areas through which light can pass so that colored patterns or shapes of activated photo-chromic areas appear visible.

Photo-chromic Writing/Drawing/Painting Apparatus

As discussed previously, a photo-chromic material may be applied by a user to a toy or a surface of a substrate. Various methods, applicators, kits, and playsets may be provided to a user to do so.

Figure 3A:
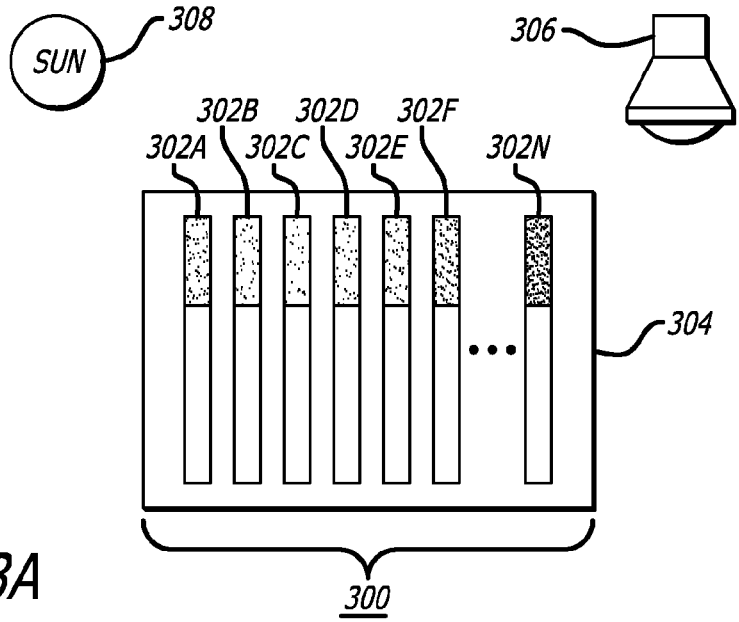
FIG. 3A is a top view of a photo-chromic pen set having different active colors when activated by various activating light sources.

Referring now to FIG. 3A, a photo-chromic ink pen set 300 is illustrated. The pen set 300 includes a plurality of N different photo-chromic ink pens 302A-302N in a support tray 304. Each of the N photo-chromic ink pens 302A-302N has a different color of photo-chromic ink that can be used to draw on toys, objects, or surfaces of substrates, such as paper for example.

After applying and its exposed to air, each of the photo-chromic inks has a binder with moisture that evaporates to dry the photo-chromic ink to the desired surface. The photo-chromic inks may be activated by an activating light when wet or dry.

If drawing or writing with photo-chromic inks indoors, a purple, violet, or ultraviolet 306 lamp may be used to activate the photo-chromic inks. For example, an overhead violet light for visualizing what is being drawn using photo-chromic inks. As another example, a light wand may be used to activate the artwork just drawn using photo-chromic inks. To display the artwork indoors, the artwork may be kept mounted under an overhead violet light source or activated using an activating light from a lamp or other user controlled source. To display the artwork outdoors, the finished image of the artwork drawn with photo-chromic inks may be taken outside into the sun to activate the photo-chromic ink and transform it into colors.

If drawing or writing with photo-chromic inks outdoors, sunlight from the sun 308 has sufficient UV radiation to activate the photo-chromic ink so as to change color from that of the substrate. That is, a child draws with photo-chromic pens or the like that include photo-chromic inks and as they draw outdoors with the sun shinning onto the ink, what is drawn is activated by the sun transforming the ink into colors. When the substrate with photo-chromic ink is brought indoors in ordinary incandescent lighting, the colors disappear after a period of time to become transparent or translucent.

Figure 4A:
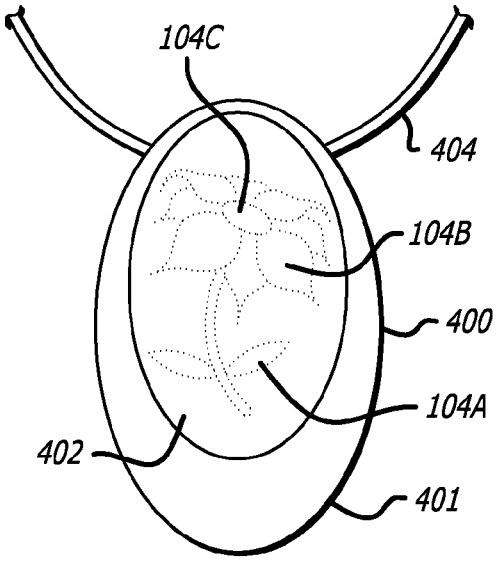
FIGS. 4A-4B are top views of a photo-chromic object decorated with one or more photo-chromic writing and drawing apparatus when respectively viewed indoors and outside in the sun.
Figure 4B:
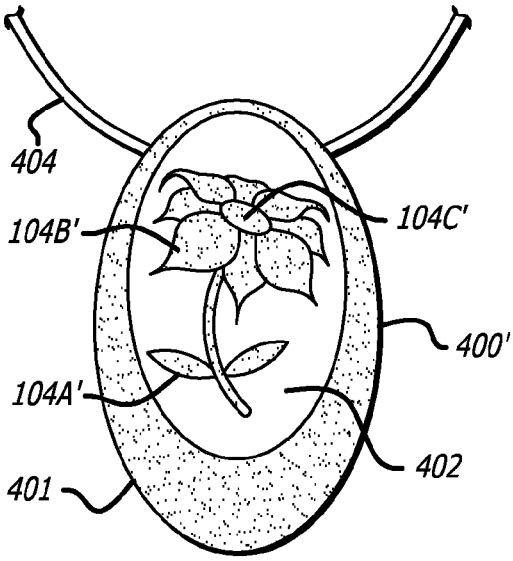

For example, consider FIGS. 4A-4B illustrating a necklace 400 that is transformed into necklace 400' in the sunlight outdoors. But for the activation and transformation of colors by the photo-chromic ink, necklace 400' is the same as necklace 400.

Necklace 400 includes a pendant 401 and a neck chain 404. The pendant 401 includes a surface 402 over which a photo-chromic ink may be drawn or painted. Photo-chromic inks 104A-104C are applied to the surface 402 of the pendant in one embodiment of the invention.

While inside or indoors away from the sunlight, the photo-chromic inks 104A-104C are transparent or translucent as illustrated in FIG. 4A. When the necklace is taken outside into the sunlight, as illustrated by necklace 401' in FIG. 4B, the inks are activated into colored photo-chromic inks 104A'-104C'. If the necklace is brought back inside or indoors, the artwork on the surface of the pendent 401 disappears as is illustrated in FIG. 4A.

Figure 5:
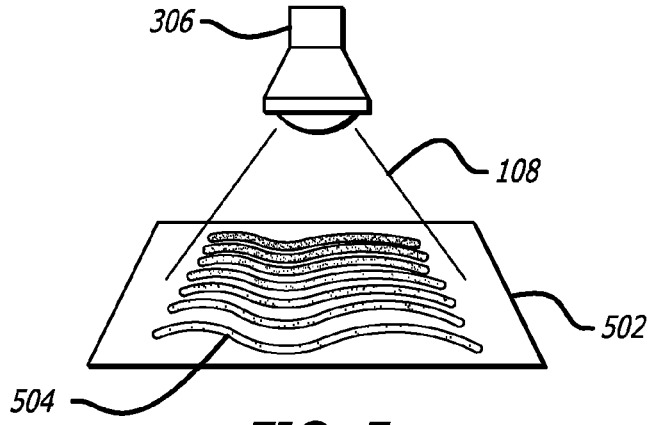
FIG. 5 is a perspective view of a design drawn under an activating light source.

As another example, consider FIG. 5 illustrating drawn photo-chromic lines 504 on a surface of a piece or page of paper 502 under the activating lamp 306. While under the activating light 118, as the pens 302A-302N are used to apply photo-chromic ink onto the surface of the paper 502, the activating light 118 activates the photo-chromic ink on the paper to transform into the selected color.

Referring now back to FIG. 3A, various types of pens may be used in the set 300. Each of the pens may be a roller ball pen or a fountain pen, for example. In another embodiment of the invention the pens 302A-302N may be substituted with pencils. In yet another embodiment of the invention, the pens 302A-302N may be substituted with felt marking pens. In still another embodiment of the invention, the pens 302A-302N may be substituted with crayons.

Figure 3B:
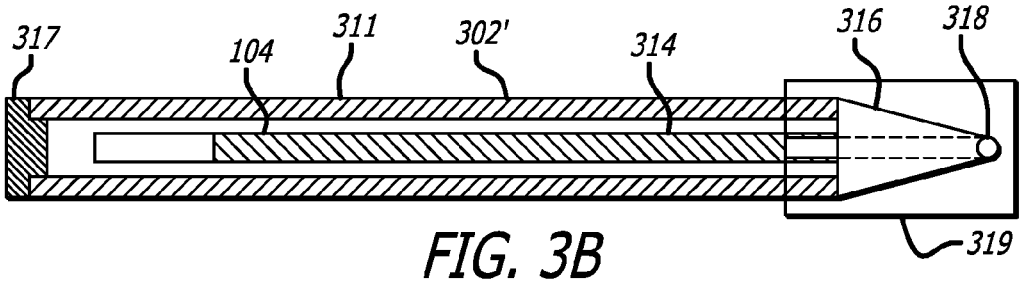
FIGS. 3B-3E are cross-sectional views of photo-chromic writing and drawing apparatus.

Referring now to FIG. 3B, a photo-chromic ball point pen 302' is illustrated. The pen 302' includes a hollow cylindrical housing 311, a cylindrical ink chamber 314 including photo-chromic ink 104, a conical end portion 316 including a roller ball 318, an end plug 317, and a cap 319 coupled together as shown. A fountain pen is similar to a ball point pen but without the roller ball.

Figure 3C:
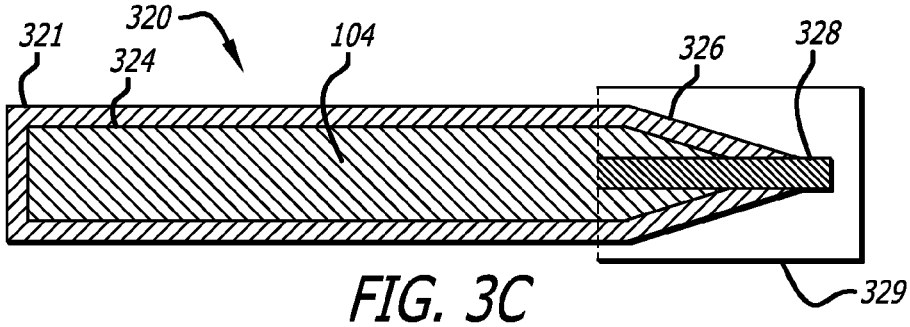

Referring now to FIG. 3C, a photo-chromic felt marking pen 320 is illustrated. The photo-chromic felt marking pen 320 includes a hollow cylindrical housing 321 including a cylindrical ink chamber 324 with photo-chromic ink 104, a conical end portion 326, a rectangular felt ink strip 328, and a cap 329 coupled together as shown. The felt ink strip 328 extends from outside the housing at one end to within the ink chamber 324 at the opposite end. The felt ink strip absorbs the photo-chromic ink at one end and expels it at another when pressed against a surface.

Figure 3D:
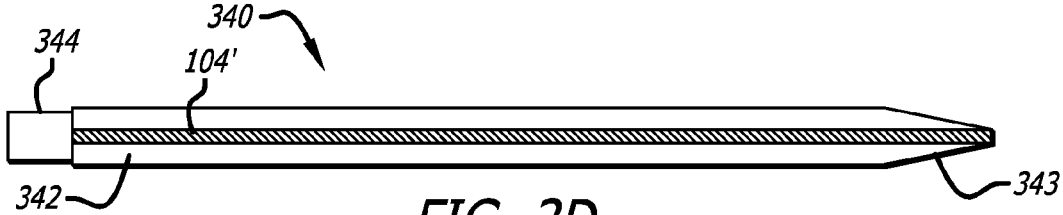

Referring now to FIG. 3D, a photo-chromic pencil 340 is illustrated. The photo-chromic pencil 340 includes a hollow cylindrical housing portion 342 wrapped around an inner cylindrical photo-chromic lead 104' portion 104' that is sharpened down to a conical end 343, and an eraser 344 at the opposite end. The eraser 344 may be a silicon rubber eraser. The inner cylindrical photo-chromic lead 104' portion 104' includes a photo-chromic material to leave clear pencil lines in ordinary light conditions while being transformed to color pencil lines under an activation light. The lead 104' is a finely ground photo-chromic solid suspended in a wax-like material.

Figure 3E:
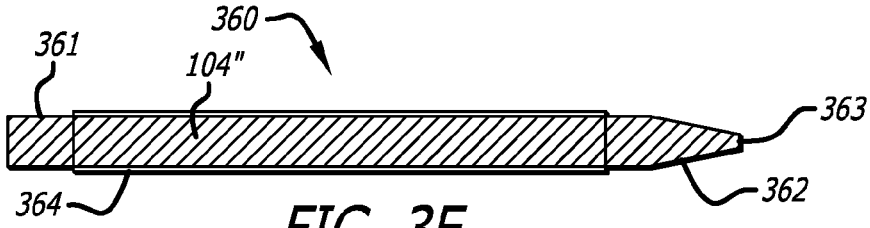

Referring now to FIG. 3E, a photo-chromic crayon 360 is illustrated. The photo-chromic crayon 360 includes a photo-chromic wax-like material 104" having a cylindrical shape over a first portion 361 and a conical shape over a second portion 362 near the end or tip 363, and a paper cylindrical sheath wrapped around a substantial portion of the cylindrical portion of the photo-chromic wax-like material 104". The material 104" is a finely ground photo-chromic solid suspended in a wax-like material.

Figure 3F:
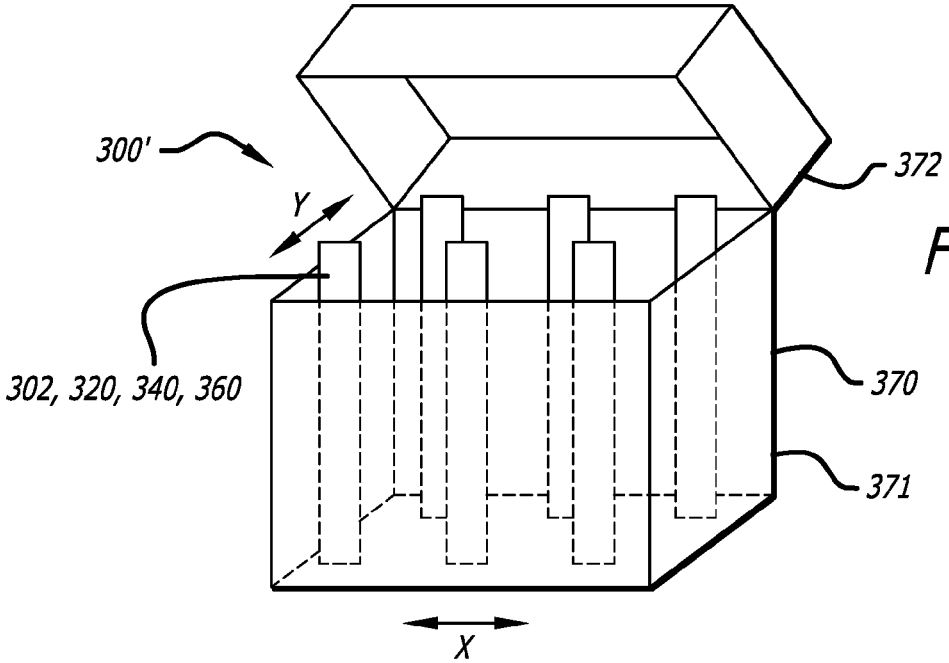
FIG. 3F is a perspective view of a boxed set of photo-chromic writing and drawing apparatus having different active colors when activated by various activating light sources.

Referring now to FIG. 3F, instead of a tray, a respective set of a plurality of photo-chromic pens 302, markers 320, pencils 340, or crayons 360 may be arranged within Y rows and X columns of a box 370. The box 370 may include a base 371 to hold the respective plurality of photo-chromic pens 302, markers 320, pencils 340, or crayons 360 therein while a lid or top 372 of the box may be opened to display each color for selection. In this manner a box full of photo-chromic crayons 360 may be presented, for example.

While drawing and writing instruments have been previously described, photo-chromic paints may be used with various types of painting instruments such as paint brushes, rollers, or sprayers for example.

Figure 6A:
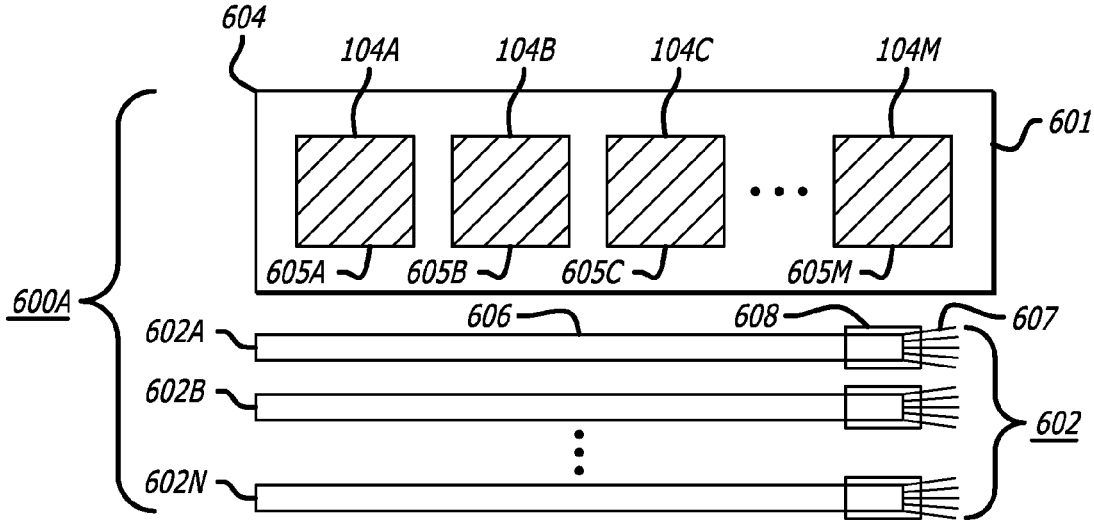
FIGS. 6A-6C illustrate views of photo-chromic paint sets.

Referring now to FIG. 6A, a first photo-chromic paint set 600A is illustrated. The photo-chromic paint set 600A includes a plurality of M photo-chromic paints 104A-104M and N paint brushes 602A-602N (where N is a variable in a range of one to another whole number; where M is a variable in a range of two to another whole number). The photo-chromic paints 104A-104M may be contained within containers 605A-605M positioned within a tray 601. The containers may be bottles with caps or lids that screw on or snap on (see FIG. 6B for example). Alternatively, the containers may be tubs within the tray having one or more caps or lids over them.

Each of the paint brushes 602A-602N (generally referred to by the reference number 602) includes a shaft 606 and bristles 607 at one end of the shaft. The bristles may be retained at the end of the shaft 606 by a crimpable sleeve 608 crimped around the shaft and to the bristles 607. The number of bristles 607 and size of the shaft may vary between the paint brushes 602A-602N to paint varying line widths.

Figure 6B:
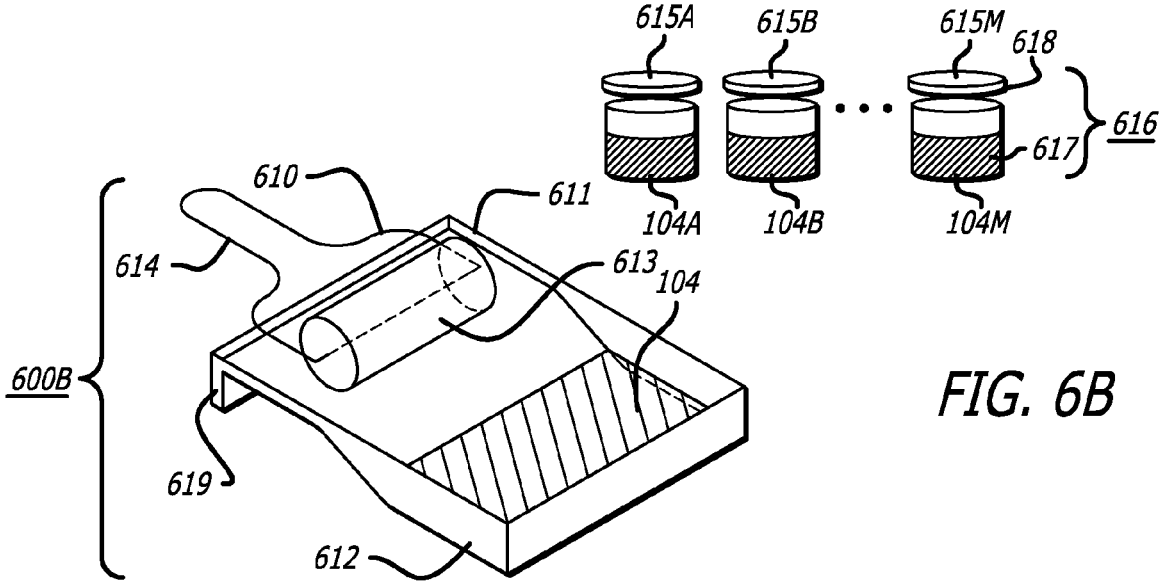

Referring now to FIG. 6B, a second photo-chromic paint set 600B is illustrated including one or more paint rollers 610, a paint roller tray 611, and a plurality of M photo-chromic paints 104A-104M. Each of the one or more paint rollers 610 includes a handle 614 and a roller 613 having an absorbing surface to absorb photo-chromic paint. The one or more paint rollers 610 may be of varying widths in order to paint a different width of area on a surface. The paint tray 611 includes a variable depth trough 612 that varies in depth from one end to another. The paint tray 611 further includes a support stand 619 coupled at a shallow end of the trough to support the tray at the shallow end so that the photo-chromic paint 104 flows towards the deep end.

The plurality of M photo-chromic paints 104A-104M may be stored in containers 615A-615M. The containers 615A-615M are bottles 616 in one embodiment of the invention and each includes a cap or lid 618 and a hollow open base 617. The cap or lid 618 may screw on or snap on to seal off the photo-chromic paints within the hollow open base 617 to avoid being dried out and spilling out.

Figure 6C:
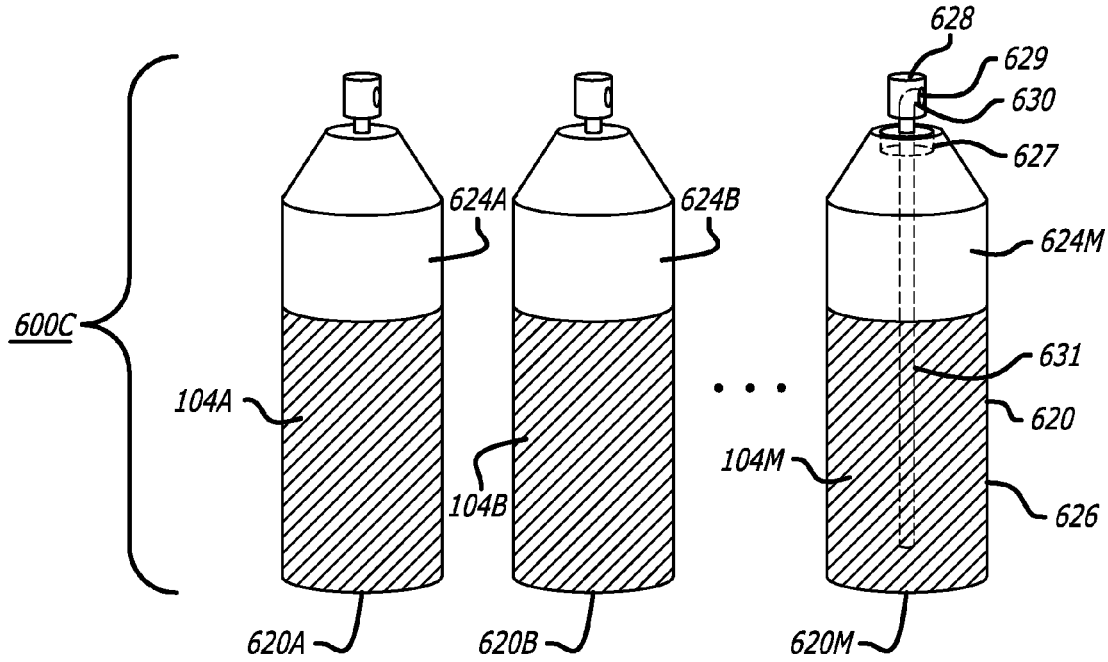

Referring now to FIG. 6C, a third photo-chromic paint set 600C is illustrated including M spray paint cans 620A-620M with photo-chromic paints 104A-104M under pressure from a pressurized gas 624A-624M in each. The pressurized gas is under a pressure greater than atmospheric pressure at an outlet 629 of the nozzle.

Each spray paint can, generally represented by the reference number 620, includes a hollow cylindrical base 626 closed at one end, a press release valve 627, a nozzle 628, and a hollow tube 631. The nozzle 628 is coupled to the press release valve 627 which is turn coupled to one end of the hollow tube 631. An opposite end of the hollow tube 631 is open near the bottom of the can within the photo-chromic paint.

When depressed, the nozzle 628 opens the press release valve 627 allowing the pressurized gas 624A-624M to push down and out on the liquid photo-chromic paint 104A-104M. The liquid photo-chromic paint 104A-104M flows up through the hollow tube 631 and the open valve 627 into a curved passage 630 in the nozzle 628. The nozzle 628 includes a spray jet opening 629 coupled to an end of the passage 630 to allow the photo-chromic paint to be sprayed out from the can in a spray pattern.

Each of the plurality of photo-chromic paints in the paint sets 600A-600C has a different color when activated by an activating light.

While hand drawing, writing, and painting apparatus for photo-chromic inks or paints were previously discussed, a more automated way of applying photo-chromic ink by a user may be had.

Photo-chromic Printing Apparatus

Figure 7A:
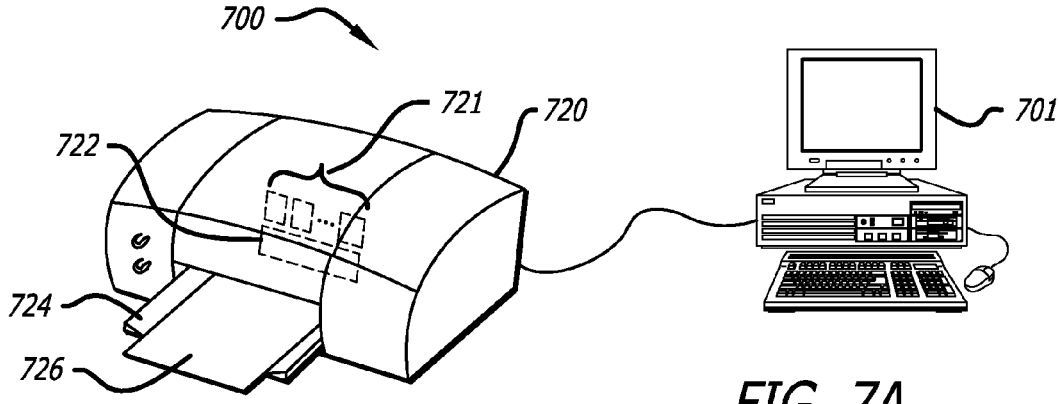
FIG. 7A illustrates a perspective view of a computer system with an photo-chromic ink printer.

Referring now to FIG. 7A, photo-chromic ink may also be used in an ink printer 720 for a computer 701 in a computer system 700. One or more ink cartridges 702A-702M of a set of ink cartridges 721 may be coupled to a print head 722 within the ink printer 720 to apply fine dots of photo-chromic ink onto a page 726 within the paper tray 724. A user may use a program of the computer 701, such as a word processing program for example, to control the printer 720 to print characters on the page in photo-chromic ink. Other programs may be used a child user to draw lines, curves, objects, or completed designs or artwork onto the page in photo-chromic ink. As the images are displayed on the computer, the photo-chromic ink need not be activated to know what is being drawn or typed on the page.

Figure 7B:
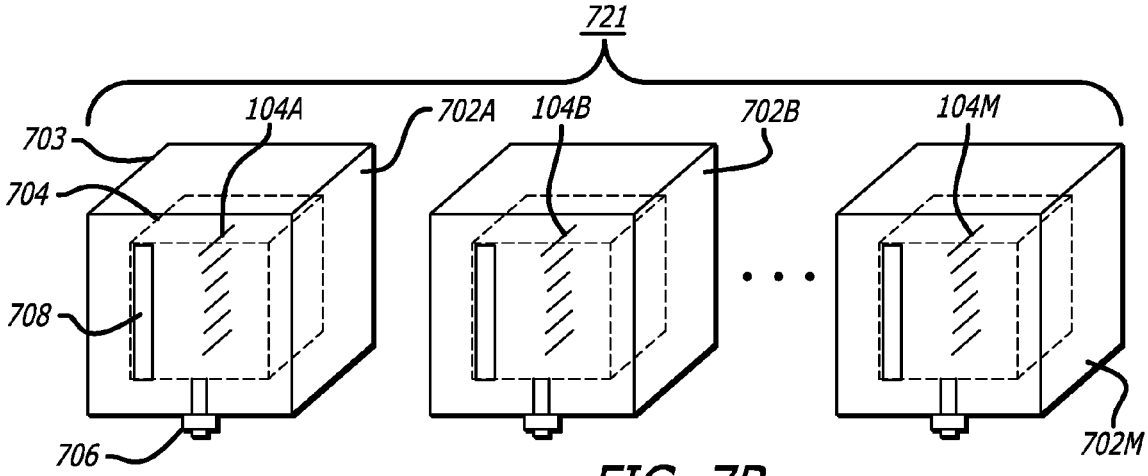
FIG. 7B illustrates a perspective view of a set of photo-chromic ink cartridges for the photo-chromic ink printer of FIG. 7A.

Referring now to FIG. 7B, a set 721 of one or more ink cartridges 702A-702M are illustrated. Each of the one or more ink cartridges 702A-702M respectively has photo-chromic inks 104A-104M with different colors upon activation by an activating light. For example, on photo-chromic ink may be black upon activation, another red upon activation, yet another blue upon activation, and still another green upon activation.

Each of the ink cartridges 702A-702M, generally referred to as 702, may include a housing 703 with a chamber 704 to hold the photo-chromic ink 104A-104M and a press release valve 706 coupled to the housing and into the chamber to receive the ink. The valve 706 opens when the ink cartridge 702 is coupled to the print head 722 so that the photo-chromic ink 104A-104M may flow out of the cartridge and into the print head. The cartridge 702 may further include a clear window 708 to see the level of liquid photo-chromic ink remaining within the cartridge 702. The cartridge may take on varying shapes including a three dimensional rhombus or a cube, for example.

The print head 722 forces out the photo-chromic ink 104A-104M as dots of ink onto the page 726. The dots can be arranged in varying densities across the page to a maximum resolution of the print head. The print head moves across the page with the ink cartridges to spray dots of photo-chromic ink in response to the program under control by the child user.

With the program implemented in software, the elements of the embodiments of the invention are essentially the code segments to perform the necessary tasks. The program or code segments can be stored in a processor readable medium or transmitted by a computer data signal embodied in a carrier wave over a transmission medium or communication link. The "processor readable medium" may include any medium that can store or transfer information. Examples of the processor readable medium include an electronic circuit, a semiconductor memory device, a read only memory (ROM), a flash memory, an erasable programmable read only memory (EPROM), a floppy diskette, a CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

Activating Lamps for Drawing/Writing/Painting

Figure 8A:
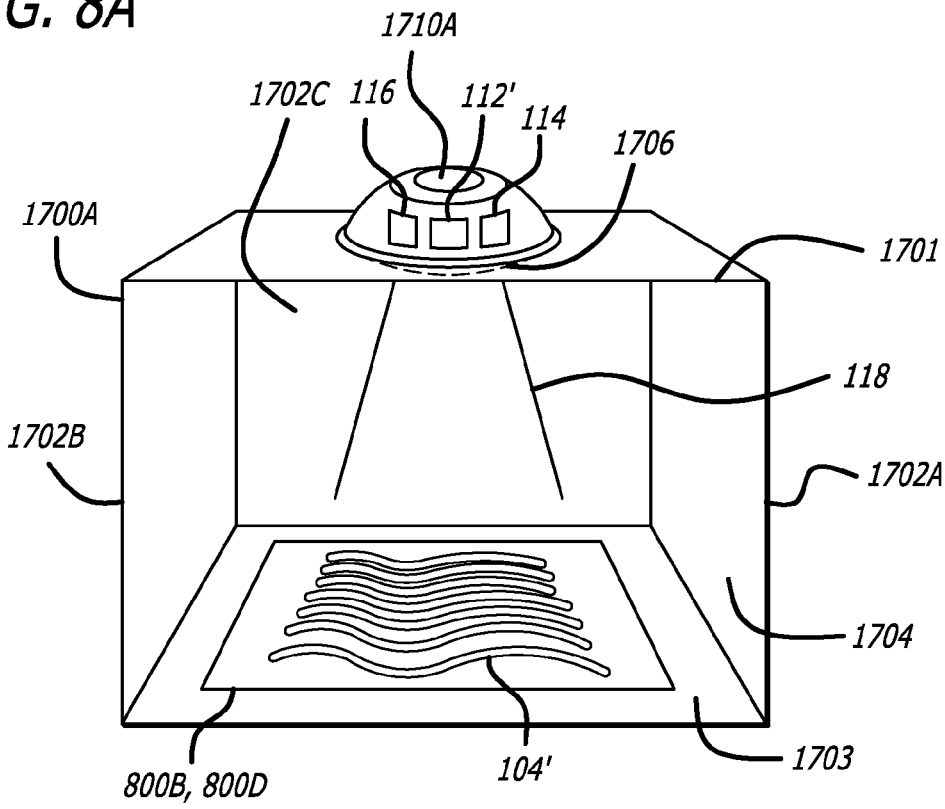
FIG. 8A illustrates an activation box.

Referring now to FIG. 8A, a photo-chromic activation box 1700A is illustrated. The activation box 1700A includes an activating lamp 1710A mounted to a top 1701 aligned with an opening 1706 therein so that the activating light 118 may shine down onto the photo-chromic page 800B,800D and activate a design 104'. The activation box 1700A further includes sides 1702A-1702C, one open side 1704, and a bottom 1703 to hold the photo-chromic page. A user can view the activated design 104' through the open side 1704. Alternatively or additionally, the sides 1702A-1702C and the top 170 may be transparent so that a user can view the activated design 104' from the top as well as any side.

The activating lamp 1710A may include one or more batteries 116, the light switch 114, and an activating light source 112 to generate the activating light 118. The light source 112 may be an ultraviolet light bulb or one or more ultraviolet light emitting diodes (UVLEDs).

Figure 8B:
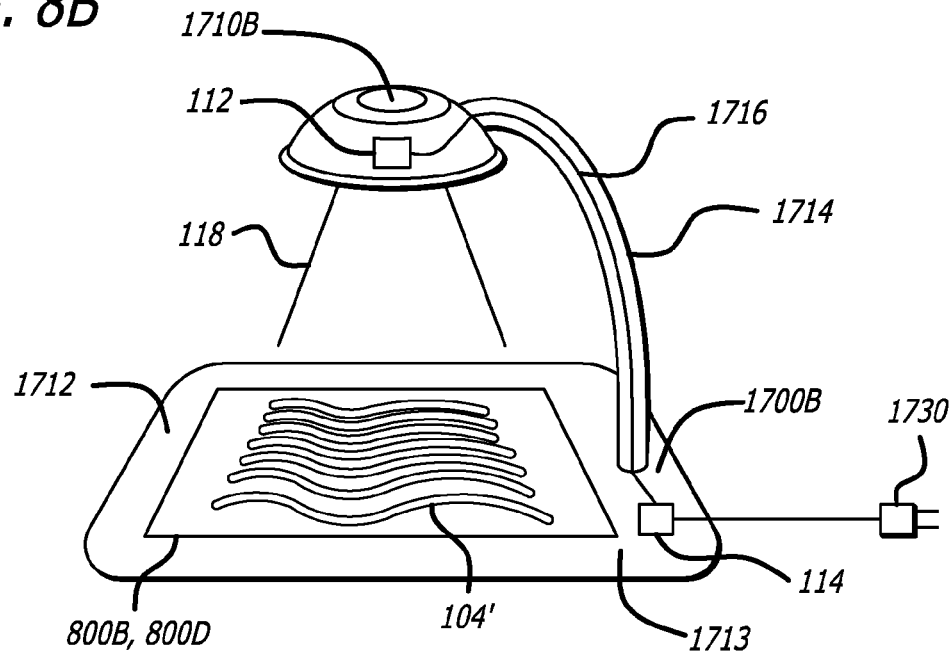
FIG. 8B illustrates an open overhead light table.

Referring now to FIG. 8B, an open overhead light table 1700B is illustrated. The light table 1700B includes an activating spot light 1710B, a support arm 1714, and a base 1712 coupled together as shown. The activating spot light 1710B is coupled to one end of the support arm 1714. An opposite end of the support arm 1714 is coupled to the base 1712. The support arm 1714 may be rigidly fixed in place or flexible to allow the spot light 1710B to be repositioned over the base 1712. The base 1712 provides a support surface within an activity area 1713 to support the photo-chromic page 800B, 800D aligned in place with the spot light 1710B. In this manner, the overhead spotlight 1710B may shine an activating light 118 down onto the photo-chromic page within the activity area 1713 so that the design therein can be activated and visualized by a user.

The support arm 1714 is hollow to allow a power cable 1716 to couple between the activating light source and the light switch 114.

The activating spot light 1710B includes an activating light source 112 to generate the activating light 118. In one embodiment of the invention, the light source 112 is an activating light bulb that continuously generates the activating light 118 while power is supplied through the switch 114. The light bulb may be an AC light bulb, in which case, the plug 1730 plugs into an AC outlet to couple AC power to the switch and the light bulb. For example, the light bulb may be a violet light bulb, or a black light bulb as it may be more commonly referred. In another embodiment of the invention, the activating light source 112 is one or more UVLEDs. In this case, the plug 1730 is a power adapter to adapt AC power at an outlet into DC power for coupling to the UVLEDs 112.

An activating lamp may be combined with one of the photo-chromic ink or paint applicators previously described as a set. Alternatively, an activating lamp may be coupled to the photo-chromic applicator.

Figure 9A:
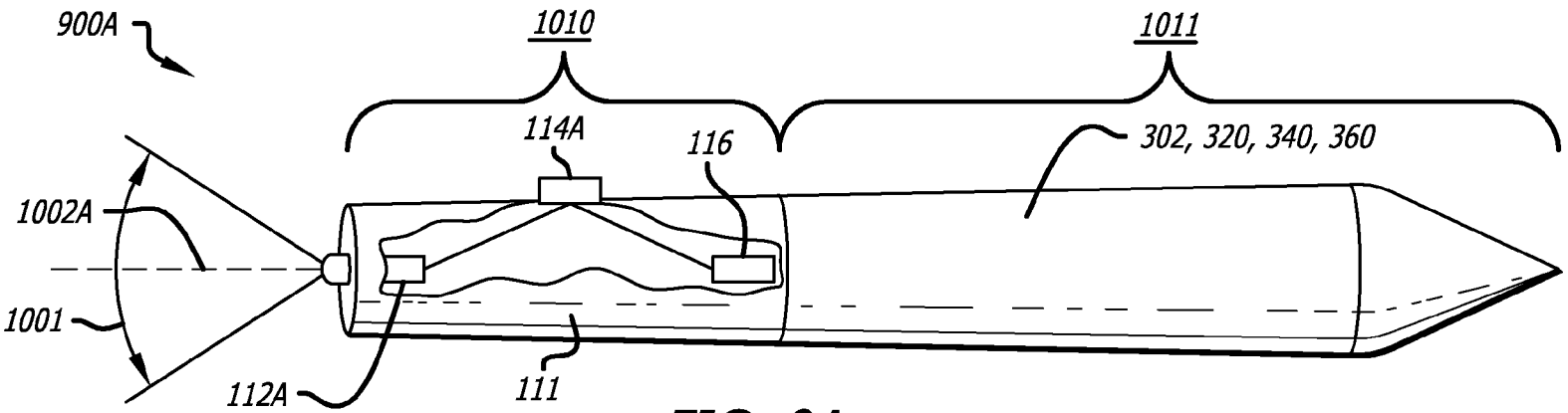
FIG. 9A illustrates a cross sectional view of a first embodiment of a combined activating light and photo-chromic applicator.

Referring now to FIG. 9A, a first embodiment of a combined activating light and photo-chromic applicator 900A is illustrated. The combined activating light and photo-chromic applicator 900A includes an activating light portion 1010 and an applicator portion 1011 coupled together.

The applicator portion 1011 may be a photo-chromic ink pen 302, a photo-chromic marker 320, a photo-chromic pencil 340, or a photo-chromic crayon 360 previously described. The applicator portion 1011 may also be referred to as a photo-chromic material applicator to apply a photo-chromic material on a surface.

The activating light portion 1010 includes a UVLED 112A mounted in a housing 111 at a first end and a switch 114A mounted to the housing 111. The housing 111 further to receive one or more batteries (rechargeable or non-rechargeable) 116 as a power source. The housing 111 has a second end coupled to an end of the applicator portion 1011 as illustrated in FIG. 9A.

The switch 114A is mounted in the housing 111 to couple between the batteries 116 and the LED 112A. The switch 114A switches power ON and OFF to the LED 112A. A variety of types of switches may be used for switching the activation light on and off in the combined light and applicator 900A. In one embodiment of the invention, the switches are momentary push button switches. A user presses and holds a button of the momentary push button switch to turn ON the activation light.

Without additional optics, the UVLED 112A can generate a wide angle spray of activation light 1001 around an optical axis 1002A to provide a spray effect over photo-chromic ink, paint or other photo-chromic material drawn on a page or toy. The wide angle spray of activation light 1001 can be used to activate the ink, paint, crayon, or other photo-chromic material drawn on a page or toy. In this manner, a child user may write or draw invisible lines and then later activate a hidden message. Otherwise, the activation light 1001 may generally be used to activate the photo-chromic material.

While FIG. 9A illustrates that the activating light portion 1010 and the applicator portion 1011 of a combined activating light and photo-chromic applicator may be at opposite ends, the activating light portion and the applicator portion can also be located at the same end to activate the photo-chromic material as it is applied to the page or object.

Figure 9B:
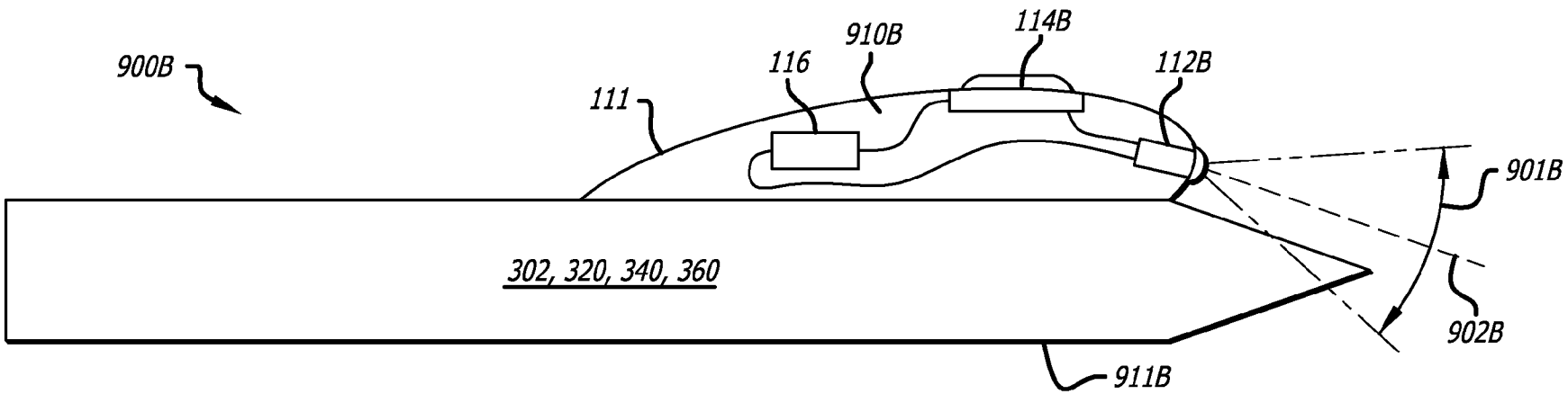
FIG. 9B illustrates a cross sectional view of a second embodiment of a combined activating light and photo-chromic applicator.

Referring now to FIG. 9B, a second embodiment of a combined activating light and photo-chromic applicator 900B is illustrated. The combined activating light and photo-chromic applicator 900B includes an activating light portion 910B and an applicator portion 911B coupled together.

The applicator portion 911B may be a photo-chromic ink pen 302, a photo-chromic marker 320, a photo-chromic pencil 340, or a photo-chromic crayon 360 previously described. The applicator portion 911B may also be referred to as a photo-chromic material applicator to apply a photo-chromic material on a surface.

The activating light portion 910B includes a UVLED 112B mounted in a housing 111 at a first end and a switch 114B mounted to the housing 111. The housing 111 further to receive one or more batteries (rechargeable or non-rechargeable) 116 as a power source. The housing 111 couples to the applicator portion 911B as illustrated in FIG. 9B and is located so as to activate the photo-chromic material as it is applied to the page or object.

The switch 114B is mounted in the housing 111 coupled between the batteries 116 and the UVLED 112B. The switch 114B switches power ON and OFF to the UVLED 112B. A variety of types of switches may be used for switching the activation light on and off in the combined light and applicator 900B. In one embodiment of the invention, the switches are momentary push button switches. A user presses and holds a button of the momentary push button switch to turn ON the activation light.

Without additional optics, the UVLED 112B can generate a wide angle spray of activation light 901B around an optical axis 902B to provide a spray effect over photo-chromic ink, paint or other photo-chromic material drawn on a page or toy. The wide angle spray of activation light 901B can be used to activate the ink, paint, crayon, or other photo-chromic material as it is drawn on a page or toy. In this manner with the light on the same end as the writing tip, one can activate and see the photo-chromic ink or material as it is applied. Otherwise, the activation light 901B from the light portion 910B may generally be used to activate the photo-chromic material.

While certain exemplary embodiments have been described and shown in the accompanying drawings, it is to be understood that such embodiments are merely illustrative of and not restrictive on the broad invention, and that the embodiments of the invention not be limited to the specific constructions and arrangements shown and described, since various other modifications may occur to those ordinarily skilled in the art. Instead, the embodiments of the invention should be construed according to the claims that follow below.

What is claimed is:

1. A photo-chromic application set comprising:

a substrate provided on a three dimensional structure or a portion thereof;

a writing instrument including photo-chromic material, the writing instrument to apply one or more layers of the photo-chromic material on the substrate; and wherein shining an activating light on a portion of the one or more layers of photo-chromic material temporarily changes the activated portion.

2. The photo-chromic application set of claim 1, further comprising:

a light pen to selectively shine the activating light on a portion of the one or more layers of photo-chromic material.

3. The photo-chromic application set of claim 2, further comprising:

a stencil having opaque areas and openings or transparent areas, the stencil to mask out portions of the activating light.

4. The photo-chromic application set of claim 1, wherein the activated portion of the photo-chromic material appears to change from a first color to a second color for a period of time before gradually decaying back to the first color.

5. The photo-chromic application set of claim 1, wherein the activating light is an ultraviolet light source.

6. The photo-chromic application set of claim 1, wherein the substrate is a solid formed out of plastics, papers, woods, metals, vinyl, fabric, combinations thereof, or other known solids.

7. A method of applying photo-chromic material comprising:

moving a tip of a writing instrument on a surface to apply a photo-chromic material, the photo-chromic material having an initial state;

shining an activating light to activate the photo-chromic ink applied to the surface; and viewing the surface including the photo-chromic ink applied thereto to detect a change in the initial state of the photo-chromic ink.

8. The method of claim 7, wherein the activating light has a wavelength substantially in or near a range of wavelengths of an ultraviolet spectrum.

9. The method of claim 7, wherein the initial state of the photo-chromic material is translucent that changes to an opaque color upon activation.

10. The method of claim 7, wherein the surface is part of a substrate of a toy, and the photo-chromic material is applied onto the toy.

11. The method of claim 7, wherein the surface is part of a page, and the photo-chromic material is applied onto the page.

12. The method of claim 7, wherein the photo-chromic material is a photo-chromic ink in liquid or colloidal form, and the method further comprises waiting for the photo-chromic ink applied to the surface to dry.

13. The method of claim 12, wherein the writing instrument is a pen including a reservoir of photo-chromic ink.

14. A combined activating light and photo-chromic applicator comprising:

a photo-chromic material applicator to apply a photo-chromic material on a surface;

a housing coupled to the photo-chromic material applicator, the housing having a first end and a second end opposite the first end, the housing to receive one or more batteries as a power source;

an ultraviolet light emitting diode (UVLED) mounted in the housing at the first end, the UVLED to generate a wide angle activation light around an optical axis in response to receiving power from the one or more batteries; and a switch mounted to the housing, the switch to switch the power from the one or more batteries ON and OFF to the UVLED.

15. The combined activating light and photo-chromic applicator of claim 14, wherein the photo-chromic material applicator is a photo-chromic ink pen, a photo-chromic marker, a photo-chromic pencil, or a photo-chromic crayon.

16. The combined activating light and photo-chromic applicator of claim 14, wherein the switch is a momentary push button switch, a user to press and hold a button of the momentary push button switch to turn ON the UVLED to generate the activation light.

17. The combined activating light and photo-chromic applicator of claim 14, wherein the second end of the housing is coupled to an end of the photo-chromic material applicator.

18. The combined activating light and photo-chromic applicator of claim 14, wherein the photo-chromic material applicator is a photo-chromic ink pen and the photo-chromic material is a photo-chromic ink, the housing is mounted to the photo-chromic ink pen near the applicating end of the photo-chromic ink pen, and the UVLED to generate the activating light in response to the switch to coincidentally activate the photo-chromic ink as it is applied to the surface.

* * * * *